US005263327A

United States Patent [19]

Drnevich et al.

[11] Patent Number: 5,263,327

[45] Date of Patent: Nov. 23, 1993

[54] HIGH RECOVERY CRYOGENIC RECTIFICATION SYSTEM

[75] Inventors: Raymond F. Drnevich, Clarence Center; Gerald A. Paolino, Williamsville, both of N.Y.

[73] Assignee: Praxair Technology, Inc., Danbury, Conn.

[21] Appl. No.: 858,212

[22] Filed: Mar. 26, 1992

[51] Int. Cl.[5] ..... F25J 3/02

[52] U.S. Cl. ..... 62/24; 62/28; 62/29; 62/30; 62/31; 62/41; 62/43; 62/44

[58] Field of Search ..... 62/24, 28, 29, 30, 31, 62/41, 43, 44

[56] References Cited

U.S. PATENT DOCUMENTS

| | | | |
|---|---|---|---|
| 3,348,385 | 10/1967 | Kamlani | 62/29 |
| 3,605,423 | 9/1971 | Stoklosinski | 62/28 |
| 4,137,056 | 1/1979 | Golovko | 62/29 X |
| 4,224,045 | 9/1980 | Olszewski et al. | 62/30 |
| 4,357,153 | 11/1982 | ERickson | 62/34 |
| 4,526,595 | 7/1985 | McNeil | 62/28 |
| 4,560,397 | 12/1985 | Cheung | 62/28 |
| 4,615,716 | 10/1986 | Cormier et al. | 62/28 X |
| 4,655,809 | 4/1987 | Shenoy | 62/18 |
| 4,662,918 | 5/1987 | Agrawal et al. | 62/13 |
| 4,705,548 | 11/1987 | Agrawal et al. | 62/28 X |
| 4,843,828 | 7/1989 | Gladman | 62/24 |
| 4,883,516 | 11/1989 | Layland et al. | 62/22 |
| 4,936,099 | 6/1990 | Woodward et al. | 62/31 X |
| 4,947,649 | 8/1990 | Agrawal et al. | 62/11 |
| 5,080,703 | 1/1992 | Rathbone | 62/38 |

*Primary Examiner*—Henry A. Bennet
*Assistant Examiner*—Christopher B. Kilner
*Attorney, Agent, or Firm*—Stanley Ktorides

[57] ABSTRACT

A cryogenic rectification system wherein oxygen-enriched liquid from a higher pressure column is vaporized against condensing nitrogen-containing fluid which is employed as additional reflux in the lower pressure column thus increasing the column L/V ratio and the product recovery.

12 Claims, 3 Drawing Sheets

HIGH RECOVERY CRYOGENIC RECTIFICATION SYSTEM

TECHNICAL FIELD

This invention relates generally to the cryogenic rectification of feed air, and is particularly advantageous for use in the production of elevated pressure product.

BACKGROUND ART

Elevated pressure product, such as oxygen and nitrogen, produced by the cryogenic rectification of feed air is increasing in demand due to such applications as coal gasification combined-cycle power plants where all of the products from the cryogenic rectification plant may be used at the elevated pressure.

One way of Producing elevated pressure product from a cryogenic rectification plant is to compress the products produced by the plant to the requisite pressure. However, this approach is costly both because of the initial capital costs and because of the high operating and maintenance costs for the compressors.

Another way of producing elevated pressure product from a cryogenic rectification plant is to operate the plant columns at a higher pressure. However, this puts a separation burden and thus a recovery burden on the system because cryogenic rectification depends on the relative volatilities of the components and these relative volatilities are reduced with increasing pressure. This is particularly the case where liquid oxygen and/or liquid nitrogen products are desired from the cryogenic rectification plant as this reduces the availability of high quality reflux which may be used to improve the separation and thus increase the Product recovery at higher rectification pressures.

Accordingly, it is an object of this invention to provide a cryogenic rectification system which can produce product at elevated pressure with improved recovery over that attainable with conventional systems.

SUMMARY OF THE INVENTION

The above and other objects which will become apparent to one skilled in the art upon a reading of this disclosure are attained by the present invention one aspect of which is:

A cryogenic rectification method for producing product with high recovery comprising:

(A) providing feed air into a higher pressure column and separating the feed air therein by cryogenic rectification into nitrogen-enriched fluid and oxygen-enriched fluid;

(B) passing nitrogen-enriched fluid into a lower pressure column operating at a pressure less than that of the higher pressure column;

(C) withdrawing oxygen-enriched fluid from the higher pressure column, reducing the pressure of the oxygen-enriched fluid, and vaporizing at least a portion of the reduced pressure oxygen-enriched fluid by indirect heat exchange with condensing nitrogen-containing fluid;

(D) passing oxygen-enriched fluid into the lower pressure column and passing nitrogen-containing fluid taken from the heat exchange with the oxygen-enriched fluid into the lower pressure column at a point above the point where oxygen-enriched fluid is passed into the lower pressure column; and (E) separating oxygen-enriched fluid and nitrogen-enriched fluid in the lower pressure column by cryogenic rectification into nitrogen-rich fluid and oxygen-rich fluid for recovery as product.

Another aspect of the Present invention is:

A cryogenic rectification plant comprising:

(A) a cryogenic rectification apparatus comprising a first column and a second column;

(B) a reflux heat exchanger, pressure reducing means, means for passing fluid from the lower portion of the first column to the pressure reducing means, from the pressure reducing means to the reflux heat exchanger, and from the reflux heat exchanger into the second column;

(C) means for passing fluid from the cryogenic rectification apparatus to the reflux heat exchanger and from the reflux heat exchanger into the second column at a point above the point where fluid from the lower portion of the first column is passed into the second column; and (D) means for recovering product from the second column.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on Packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation Process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in Part, at low temperatures, such as at temperatures at or below 150° K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the term "compressor" means a device for increasing the Pressure of a gas.

As used herein, the term "expander" means a device used for extracting work out of a compressed gas by decreasing its pressure.

As used herein, the terms "upper portion" and "lower portion" mean those sections of a column respectively above and below the midpoint of a column.

As used herein, the term "reflux" means the downflowing liquid phase in a column produced from condensing vapor.

As used herein, the term "L/V ratio" means the ratio of the quantity of liquid flowing down a column to the quantity of vapor rising in the column.

DETAILED DESCRIPTION

In general, the invention is a system which improves product recovery, especially product oxygen recovery, by employing refrigeration from the lower portion of the high pressure column to condense nitrogen thus increasing the L/V ratio in the upper portion of the lower pressure column.

Figure 1:
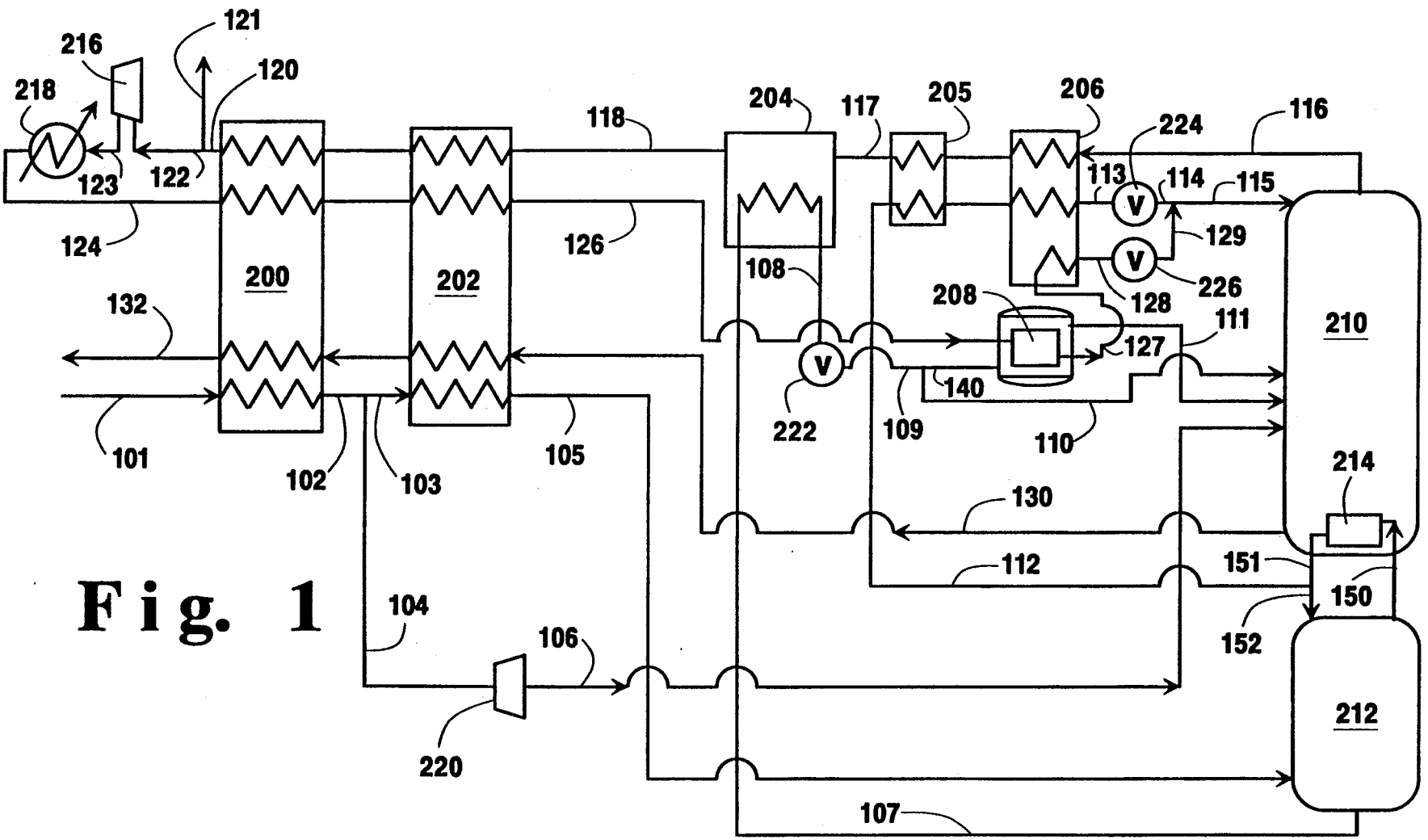
FIG. 1 is a schematic representation of one preferred embodiment of the invention wherein the condensing nitrogen-containing fluid is taken from the lower pressure column.

The invention will be described in detail with reference to the Drawings. Referring now to FIG. 1, compressed feed air 101 which has been cleaned of high boiling impurities such as water vapor, carbon dioxide, and hydrocarbons is cooled by passage through heat exchanger 200 by indirect heat exchange with return streams. A portion 103 of resulting cooled feed air 102, comprising from 85 to 100 percent of the feed air, is further cooled by passage through heat exchanger 202 by indirect heat exchange with return streams and resulting further cooled stream 105 is passed into first or higher pressure column 212. Another portion 104 comprising from 0 to 15 percent of the feed air is expanded through expander 220 to generate refrigeration for the cryogenic rectification and resulting expanded stream 106 is passed into second or lower pressure column 210.

First or higher pressure column 212 is the higher pressure column of a double column cryogenic rectification apparatus and is operated at a pressure within the range of from 60 to 300 pounds per square inch absolute (psia). Within column 212 feed air is separated by cryogenic rectification into nitrogen-enriched fluid and oxygen-enriched fluid. Nitrogen-enriched fluid is withdrawn from column 212 as vapor stream 150 which is condensed by passage through main condenser 214 in indirect heat exchange with boiling column 210 bottoms. Resulting condensed nitrogen-enriched fluid 151 is passed out of main condenser 214 and a portion 152 is passed back into column 212 as reflux. Another Portion 112 of nitrogen-enriched fluid 151 is subcooled by passage through heat exchangers 205 and 206, resulting stream 113 is expanded through valve 224 and resulting stream 114 is passed into column 210 as reflux. In the embodiments illustrated in the Figures stream 114 is combined with condensed nitrogen-containing fluid as will be discussed in greater detail below and this combined stream 115 is passed into column 210.

Oxygen-enriched fluid is withdrawn from column 212 as liquid stream 107. The withdrawn oxygen-enriched liquid is subcooled by passage through heat exchanger 204 and resulting subcooled oxygen-enriched liquid 108 is reduced in pressure by passage through pressure reduction valve 222 to produce reduced pressure stream 109 which is essentially at the operating pressure of lower pressure column 210. A portion 110 of stream 109 is passed directly into column 210. Another portion 140 of stream 109 is passed into reflux heat exchanger 208 wherein it is vaporized by indirect heat exchange with condensing nitrogen-containing fluid which has been taken from the double column cryogenic rectification apparatus as will be discussed in greater detail below. Resulting vaporized oxygen-enriched fluid 111 is then passed out from reflux heat exchanger 208 and into column 210.

Second or lower pressure column 210 is the lower pressure column of double column cryogenic rectification apparatus and is operated at a pressure lower than that of column 212 and within the range of from 15 to 200 psia. Within column 210 nitrogen-enriched and oxygen-enriched fluids are separated by cryogenic rectification into nitrogen-rich fluid and oxygen-rich fluid. Oxygen-rich fluid is withdrawn from column 210 as stream 130 which is warmed by passage through heat exchangers 202 and 200 and recovered as oxygen product 132 having a purity within the range of from 50 to 100 percent.

In the embodiment of the invention illustrated in FIG. 1, the nitrogen-containing fluid condensed in reflux heat exchanger 208 is nitrogen-rich fluid taken from lower Pressure column 210. Nitrogen-rich fluid is withdrawn from lower pressure column 210 as vapor stream 116 which is warmed by passage through heat exchangers 206 and 205 by indirect heat exchange with subcooling nitrogen-enriched liquid. Resulting warmed nitrogen-rich vapor 117 is further warmed by passage through heat exchanger 204 by indirect heat exchange with subcooling oxygen-enriched liquid. Resulting further warmed nitrogen-rich vapor 118 is still further warmed by passage through heat exchangers 202 and 200 to produce nitrogen-rich vapor stream 120, a portion of which may be recovered as nitrogen product 121 having a nitrogen purity of at least 97 percent.

Another portion 122 of stream 120 is compressed by passage through compressor 216. Compressed nitrogen-rich vapor 123 is passed through cooler 218 and resulting stream 124 is cooled by passage through heat exchangers 200 and 202. Compressed, cooled nitrogen-rich vapor 126 is passed as the nitrogen-containing fluid to reflux heat exchanger 208 wherein it is condensed by the aforesaid indirect heat exchange with vaporizing oxygen-enriched fluid. Resulting condensed nitrogen-rich liquid 127 is subcooled by passage through heat exchanger 206. Resulting subcooled nitrogen-rich liquid 128 is reduced in pressure through valve 226 and resulting reduced pressure stream 129 is passed into column 210 as additional reflux at a point above the point or points where oxygen-enriched fluid is passed into lower pressure column 210. As discussed previously, in this illustrated embodiment stream 129 is first combined with stream 114 and the resulting combined stream 115 passed into column 210.

As indicated, the condensation of the nitrogen-containing fluid in the reflux heat exchanger against oxygen-enriched fluid and the subsequent introduction of the condensed nitrogen-containing fluid into the lower pressure column at a point higher than the introduction point of the oxygen-enriched fluid provides additional reflux for the lower pressure column thus improving the L/V ratio in the upper portion of the lower pressure column. The L/V ratio is efficiently increased because the nitrogen-containing fluid can be condensed against boiling oxygen-enriched fluid at a relatively low pressure, significantly lower than if it were condensed against oxygen-rich fluid such as by passage through main condenser 214. Furthermore, the lower pressure reduces flashoff losses incurred when the fluid is passed into the lower pressure column. The increased L/V ratio in the lower pressure column increases the recovery by reducing the concentration of the less volatile component on each tray in the upper portion of the column thus reducing the fraction of the less volatile component leaving each tray and leaving the column.

Figure 2:
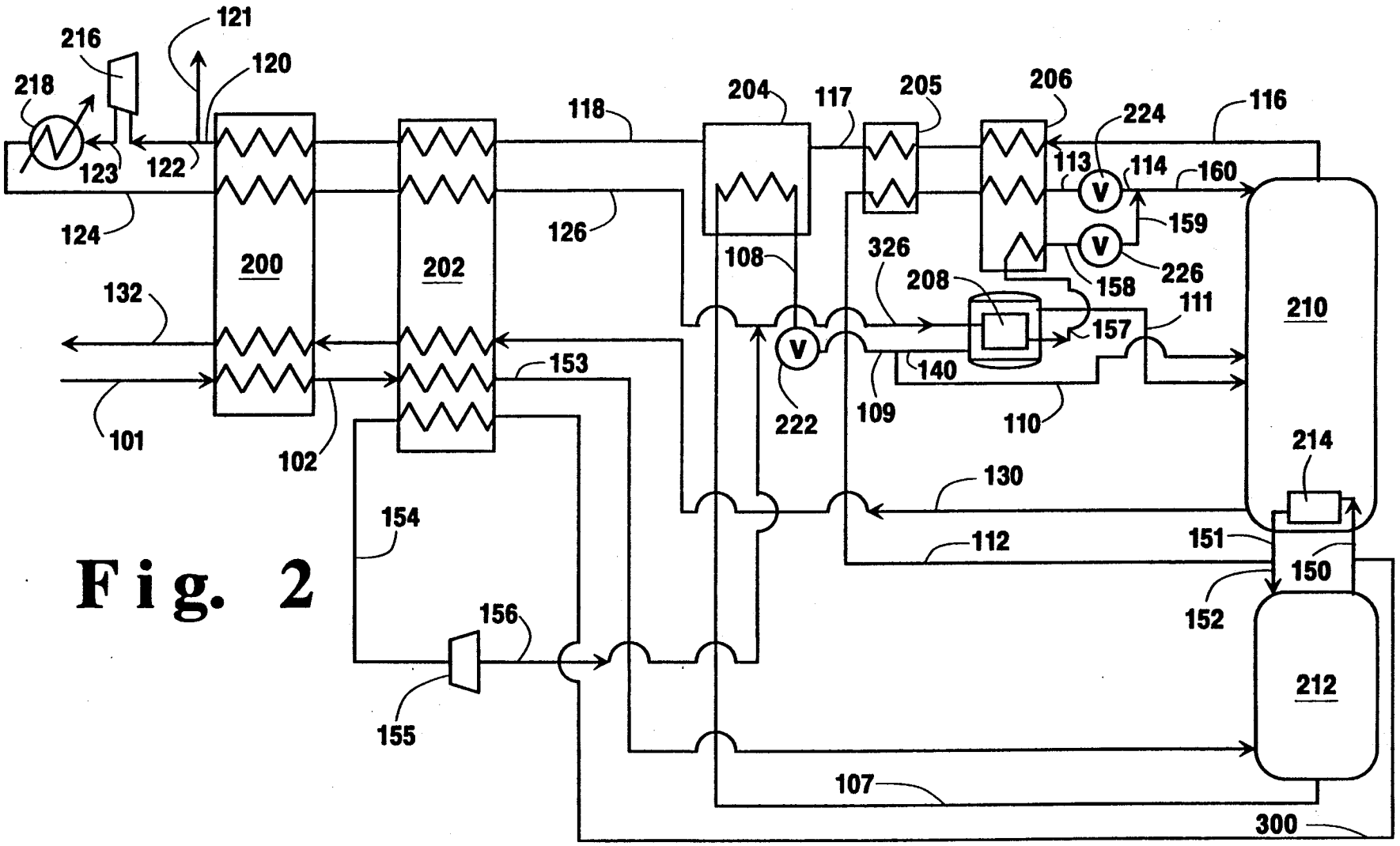
FIG. 2 is schematic representation of another preferred embodiment of the invention wherein the condensing nitrogen-containing fluid is taken from both the lower pressure column and the higher pressure column.

FIG. 2 illustrates another embodiment of the invention wherein, in addition to the nitrogen-rich fluid from the lower pressure column, the nitrogen-containing fluid condensed in the reflux heat exchanger comprises nitrogen-enriched fluid taken from the higher pressure column. The numerals in FIG. 2 correspond to those of FIG. 1 for the common elements and these common elements will not be discussed again in detail. In the embodiment illustrated in FIG. 2 the entire feed air stream 102 is cooled through heat exchanger 202 and resulting stream 153 is passed into higher pressure column 212. A portion 300 of nitrogen-enriched vapor stream 150 is warmed by passage through heat exchanger 202 and resulting warmed nitrogen-enriched vapor 154 is expanded through expander 155 to generate refrigeration. Expanded stream 156 is then combined with stream 126 and combined stream 326 is passed into reflux heat exchanger 208 wherein it is condensed by indirect heat exchange with oxygen-enriched fluid. Resulting condensed stream 157 is subcooled by passage through heat exchanger 206. Resulting subcooled liquid 158 is reduced in pressure through valve 226 and resulting reduced pressure stream 159 is passed into lower pressure column 210 as additional reflux at a point above the point or points where oxygen-enriched fluid is passed into column 210. In this embodiment stream 159 is first combined with stream 114 and the resulting combined stream 160 is passed into column 210.

Figure 3:
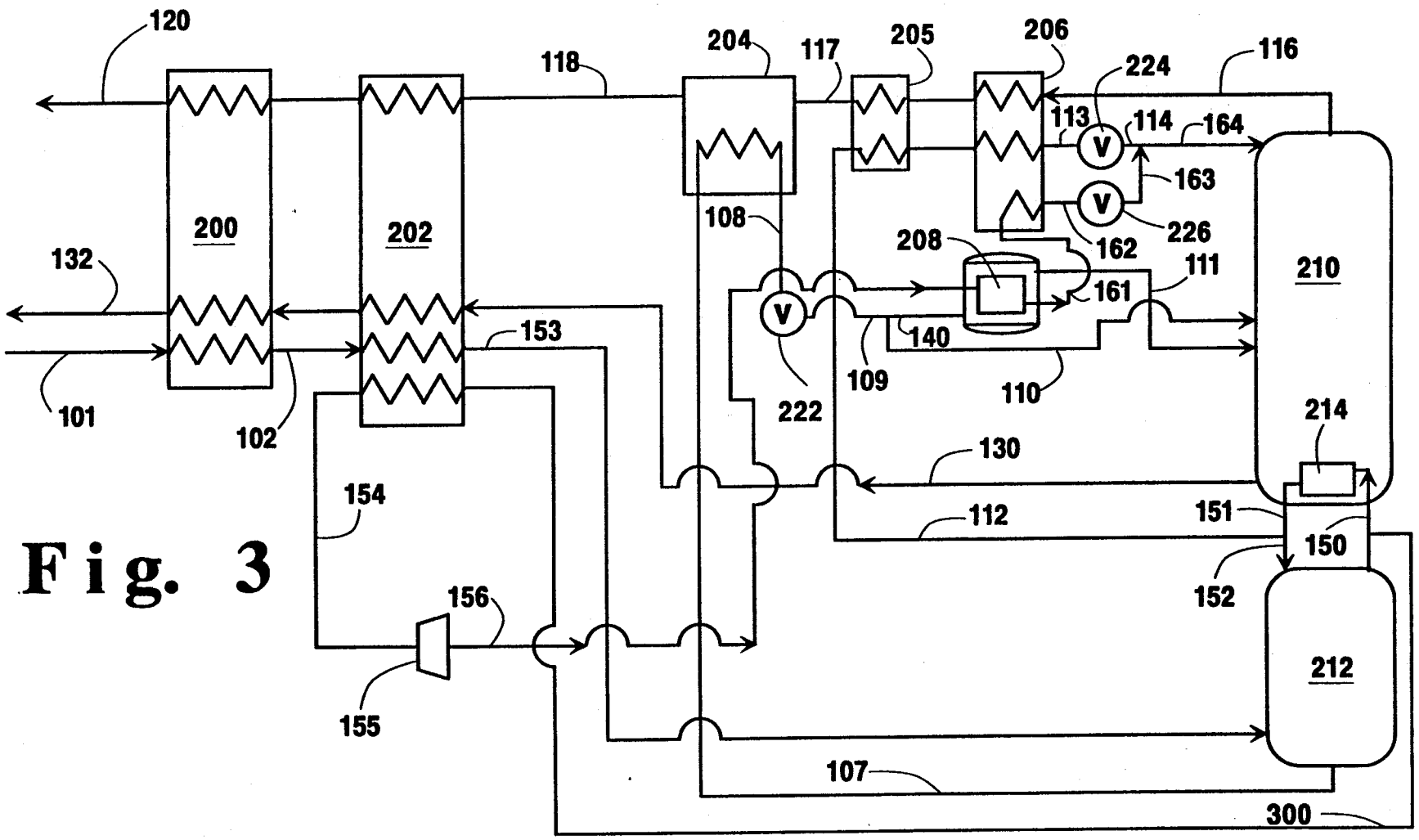
FIG. 3 is a schematic representation of another preferred embodiment of the invention wherein the condensing nitrogen-containing fluid is taken from the higher pressure column.

FIG. 3 illustrates yet another embodiment of the invention wherein the nitrogen-containing fluid condensed in the reflux heat exchanger comprises only nitrogen-enriched fluid taken from the higher pressure column. The numerals in FIG. 3 correspond to those of FIGS. 1 and 2 for the common elements and these common elements will not be discussed again in detail. In the embodiment illustrated in FIG. 3 the entire nitrogen-rich vapor stream 120 is removed from the process and may be recovered as nitrogen product. It is understood that in the practice of this invention oxygen-rich fluid and nitrogen-rich fluid produced for recovery as product need not be recovered, in whole or in part, as product and may be simply removed from the system. Expanded nitrogen-enriched vapor 156 is passed as the nitrogen-containing fluid to reflux heat exchanger 208 wherein it is condensed by indirect heat exchange with vaporizing oxygen-enriched fluid. Resulting condensed nitrogen-enriched liquid 161 is subcooled by passage through heat exchanger 206. Resulting subcooled nitrogen-enriched liquid 162 is reduced in pressure through valve 226 and resulting reduced pressure stream 163 is passed into column 210 as additional reflux at a point above the point or points where oxygen-enriched fluid is passed into lower pressure column 210. In this illustrated embodiment stream 163 is first combined with stream 114 and the resulting combined stream 164 is passed into column 210.

Which of the three illustrated preferred embodiments will be the most appropriate for any particular situation will depend on several factors including the Pressure at which the feed air is available. If feed air is available at about 150 psia, the embodiment illustrated in FIG. 3 will likely be the most appropriate. If feed air is available at 250 psia, the embodiment illustrated in FIG. 2 will likely be the most appropriate. The embodiment illustrated in FIG. 1 would be most appropriate for an intermediate air feed pressure.

Now, by the use of this invention feed air may be separated into both nitrogen and oxygen products under elevated pressure while still obtaining high product recovery. The invention can produce oxygen product with a recovery of at least 95 percent up to about 99.9 percent. Although the invention has been described in detail with reference to certain preferred embodiments, those skilled in the art will recognize that there are other embodiments of the invention within the spirit and the scope of the claims.

We claim:

1. A cryogenic rectification method for producing product with high recovery comprising:

(A) providing feed air into a higher pressure column and separating the feed air therein by cryogenic rectification into nitrogen-enriched fluid and oxygen-enriched fluid;

(B) passing nitrogen-enriched fluid into a lower pressure column operating at a pressure less than that of the higher pressure column;

(C) withdrawing oxygen-enriched fluid from the higher pressure column, reducing the pressure of the entire withdrawn oxygen-enriched fluid to about the operating pressure of the lower pressure column, vaporizing a portion of the resulting reduced pressure oxygen-enriched fluid by indirect heat exchange with condensing nitrogen-containing fluid, and passing another portion of the resulting reduced pressure oxygen-enriched fluid directly into the lower pressure column;

(D) passing vaporized oxygen-enriched fluid into the lower pressure column and passing nitrogen-containing fluid taken from the heat exchange with the oxygen-enriched fluid into the lower pressure column at a point above the point where vaporized oxygen-enriched fluid is passed into the lower pressure column; and (E) separating oxygen-enriched fluid and nitrogen-enriched fluid in the lower pressure column by cryogenic rectification into nitrogen-rich fluid and oxygen-rich fluid for recovery as product.

2. The method of claim 1 wherein nitrogen-rich vapor is withdrawn from the lower pressure column, warmed, compressed, cooled and employed as nitrogen-containing fluid condensing by indirect heat exchange with oxygen-enriched fluid.

3. The method of claim 2 wherein nitrogen-enriched vapor is withdrawn from the higher pressure column, expanded and employed as nitrogen-containing fluid condensing by indirect heat exchange with oxygen-enriched fluid.

4. The method of claim 1 wherein nitrogen-enriched vapor is withdrawn from the higher pressure column, expanded and employed as nitrogen-containing fluid condensing by indirect heat exchange with oxygen-enriched fluid.

5. A cryogenic rectification plant comprising:

(A) a cryogenic rectification apparatus comprising a first column and a second column;

(B) a reflux heat exchanger, pressure reducing means, means for passing fluid from the lower portion of the first column to the pressure reducing means, from the pressure reducing means (1) directly into the second column without passing through further pressure reducing means and (2) to the reflux heat exchanger and from the refulx heat exchanger into the second column;

(C) means for passing fluid from the cryogenic rectification apparatus to the reflux heat exchanger and from the reflux heat exchanger into the second column at a point above the point where fluid from the lower portion of the first column is passed from the reflux heat exchanger into the second column; and (D) means for recovering product from the second column.

6. The cryogenic rectification plant of claim 5 wherein the means for passing fluid from the cryogenic rectification apparatus to the reflux heat exchanger comprises a compressor, means for passing fluid from the upper portion of the second column to the compressor, and means for passing fluid from the compressor to the reflux heat exchanger.

7. The cryogenic rectification plant of claim 5 wherein the means for passing fluid from the cryogenic rectification apparatus to the reflux heat exchanger comprises an expander, means for passing fluid from the upper portion of the first column to the expander, and means for passing fluid from the expander to the reflux heat exchanger.

8. The cryogenic rectification plant of claim 5 wherein the means for passing fluid from the cryogenic rectification apparatus to the reflux heat exchanger comprises a compressor, means for passing fluid from the upper portion of the second column to the compressor, means for passing fluid from the compressor to the reflux heat exchanger, an expander, means for passing fluid from the upper portion of the first column to the expander, and means for passing fluid from the expander to the reflux heat exchanger.

9. A cryogenic rectification method for producing product with high recovery comprising:

(A) providing feed air into a higher pressure column and separating the feed air therein by cryogenic rectification into nitrogen-enriched fluid and oxygen-enriched fluid;

(B) passing nitrogen-enriched fluid into a lower pressure column operating at a pressure less than that of the higher pressure column;

(C) withdrawing oxygen-enriched fluid from the higher pressure column, reducing the pressure of the oxygen-enriched fluid, and vaporizing at least a portion of the reduced pressure oxygen-enriched fluid by indirect heat exchange with condensing nitrogen-containing fluid which comprises vapor which has been withdrawn from the lower pressure column and warmed, compressed and cooled, and vapor which has been withdrawn from the higher pressure column and expanded;

(D) passing oxygen-enriched fluid into the lower pressure column and passing nitrogen-containing fluid taken from the heat exchange with the oxygen-enriched fluid into the lower pressure column at a point above the point where oxygen-enriched fluid is passed into the lower pressure column; and (E) separating oxygen-enriched fluid and nitrogen-enriched fluid in the lower pressure column by cryogenic rectification into nitrogen-rich fluid and oxygen-rich fluid for recovery as product.

10. A cryogenic rectification method for producing product with high recovery comprising:

(A) providing feed air into a higher pressure column and separating the feed air therein by cryogenic rectification into nitrogen-enriched fluid and oxygen-enriched fluid;

(B) passing nitrogen-enriched fluid into a lower pressure column operating at a pressure less than that of the higher pressure column;

(C) withdrawing oxygen-enriched fluid from the higher pressure column, reducing the pressure of the oxygen-enriched fluid, and vaporizing at least a portion of that reduced pressure oxygen-enriched fluid by indirect heat exchange with condensing nitrogen-containing fluid which comprises vapor which has been withdrawn from the higher pressure column and expanded;

(D) passing oxygen-enriched fluid into the lower pressure column and passing nitrogen-containing fluid taken from the heat exchange with the oxygen-enriched fluid into the lower pressure column at a point above the point where oxygen-enriched fluid is passed into the lower pressure column; and (E) separating oxygen-enriched fluid and nitrogen-enriched fluid in the lower pressure column by cryogenic rectification into nitrogen-rich fluid and oxygen-rich fluid for recovery as product.

11. A cryogenic rectification plant comprising:

(A) a cryogenic rectification apparatus comprising a first column and a second column;

(B) a reflux heat exchanger, pressure reducing means, means for passing fluid from the lower portion of the first column to the pressure reducing means, from the pressure reducing means to the reflux heat exchanger, and from the reflux heat exchanger into the second column;

(C) means for passing fluid from the cryogenic rectification apparatus to the reflux heat exchanger and from the reflux heat exchanger into the second column at a point above the point where fluid from the lower portion of the first column is passed into the second column; and (D) means for recovering product from the second column; wherein the means for passing fluid from the cryogenic rectification apparatus to the reflux heat exchanger comprises an expander, means for passing fluid from the upper portion of the first column to the expander, and means for passing fluid from the expander to the reflux heat exchanger.

12. A cryogenic rectification plant comprising:

(A) a cryogenic rectification apparatus comprising a first column and a second column;

(B) a reflux heat exchanger, pressure reducing means, means for passing fluid from the lower portion of the first column to the pressure reducing means, from the pressure reducing means to the reflux heat exchanger, and from the reflux heat exchanger into the second column;

(C) means for passing fluid from the cryogenic rectification apparatus to the reflux heat exchanger and from the reflux heat exchanger into the second column at a point above the point where fluid from the lower portion of the first column is passed into the second column; and (D) means for recovering product from the second column; wherein the means for passing fluid from the cryogenic rectification apparatus to the reflux heat exchanger comprises a compressor, means for passing fluid from the upper portion of the second column to the compressor, means for passing fluid from the compressor to the reflux heat exchanger, an expander, means for passing fluid from the upper portion of the first column to the expander, and means for passing fluid from the expander to the reflux heat exchanger.

* * * * *